US007377625B2

(12) United States Patent
Koyama et al.

(10) Patent No.: US 7,377,625 B2
(45) Date of Patent: May 27, 2008

(54) METHOD FOR PRODUCING INK-JET RECORDING HEAD HAVING FILTER, INK-JET RECORDING HEAD, SUBSTRATE FOR RECORDING HEAD, AND INK-JET CARTRIDGE

(75) Inventors: Shuji Koyama, Kawasaki (JP); Kenji Fujii, Hiratsuka (JP); Shingo Nagata, Machida (JP); Jun Yamamuro, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 304 days.

(21) Appl. No.: 11/157,761

(22) Filed: Jun. 21, 2005

(65) Prior Publication Data

US 2005/0285916 A1 Dec. 29, 2005

(30) Foreign Application Priority Data

Jun. 25, 2004 (JP) ..... 2004-188890

(51) Int. Cl.
*B41J 2/05* (2006.01)

(52) U.S. Cl. ..... 347/56; 347/63; 29/611

(58) Field of Classification Search ..... 347/20, 347/56, 61–65, 67, 92–93; 29/611, 890.1
See application file for complete search history.

(56) References Cited

U.S. PATENT DOCUMENTS

| | | | | |
|---|---|---|---|---|
| 5,478,606 | A | 12/1995 | Ohkuma et al. | 216/27 |
| 6,139,761 | A | 10/2000 | Ohkuma | 216/27 |
| 6,264,309 | B1 | 7/2001 | Sullivan | 347/63 |
| 6,336,713 | B1 * | 1/2002 | Regan et al. | 347/62 |
| 6,336,714 | B1 * | 1/2002 | Kawamura et al. | 347/65 |
| 6,543,884 | B1 | 4/2003 | Kawamura et al. | 347/65 |
| 6,799,839 | B2 | 10/2004 | Hayakawa et al. | 347/64 |
| 2005/0117005 | A1 | 6/2005 | Fujii et al. | 397/92 |

FOREIGN PATENT DOCUMENTS

| | | |
|---|---|---|
| JP | 2000-94700 A | 4/2000 |
| JP | 2003-136492 A | 5/2003 |

* cited by examiner

*Primary Examiner*—Juanita D. Stephens
(74) *Attorney, Agent, or Firm*—Canon USA Inc I.P. Div

(57) ABSTRACT

In a method for producing an ink-jet recording head, a plurality of through-holes is formed in a heat storage layer formed on one surface of a silicon substrate, subsequently, heating elements are formed, and a protective layer is formed on the substrate. A passage-forming member forming discharge ports and ink passages is formed on the protective layer and an ink supply port is then formed by anisotropic etching from the other surface of the silicon substrate. In this step, since the protective layer serves as an etching stop layer, the passage-forming member is not in contact with an etchant. Subsequently, the protective layer formed in the through-holes is removed so that the ink supply port includes a filter.

4 Claims, 4 Drawing Sheets

METHOD FOR PRODUCING INK-JET RECORDING HEAD HAVING FILTER, INK-JET RECORDING HEAD, SUBSTRATE FOR RECORDING HEAD, AND INK-JET CARTRIDGE

BACKGROUND OF THE INVENTION

1. Field of the Invention

The present invention relates to a method for producing an ink-jet recording head used for recording by discharging droplets, an ink-jet recording head, a substrate for a recording head, and an ink-jet cartridge, and more specifically, to a method for producing an ink-jet recording head including a filter, the ink-jet recording head, a substrate for the recording head, and an ink-jet cartridge including the recording head.

2. Description of the Related Art

Recently, in order to achieve a reduction in size and a high density of an ink-jet recording head, a method for installing an electric control circuit that drives an element for generating an ink-discharging pressure in a substrate has been proposed. The electric control circuit is installed in the substrate using a semiconductor manufacturing technology. According to such an ink-jet recording head, in order to supply a plurality of discharge ports with ink, the substrate is pierced from the reverse face so that each nozzle communicates with a common ink supply port through the substrate and the ink is supplied to each nozzle from the common ink supply port. U.S. Pat. No. 5,478,606 discloses a method for manufacturing such an ink-jet recording head in which the distance between the element for generating an ink-discharging pressure, the element being used for discharging ink from a discharge port, and the discharge port can be controlled with a very high accuracy. In addition, as disclosed in U.S. Pat. No. 6,139,761, when a silicon substrate is used as a substrate of such an ink-jet recording head, the ink supply port can be formed by anisotropic etching.

One of the expectations required for an ink-jet recording head is preventing dust or foreign matter from infiltrating in nozzles. Such dust or foreign matter may infiltrate into the nozzles during the manufacturing process of the ink-jet recording head. Also, such dust or foreign matter may be sent with the ink and then may infiltrate into the nozzles. In order to solve this problem, a filter is provided in the ink-jet recording head.

For example, according to a recording head disclosed in U.S. Pat. No. 6,264,309, a member in which discharging ports and passages are to be formed is bonded with a silicon substrate including an ink supply port. In the above ink-jet recording head, a resistant material layer used for forming the ink supply port by etching is provided on the surface having a heater, and a plurality of pores is provided through the resistant material layer. Thus, the ink supply port and a filter are formed at the same time. In addition, U.S. Pat. No. 6,543,884 discloses a structure wherein separate ink supply ports corresponding to a plurality of ink-jet chambers are provided.

According to Japanese Patent Laid-Open No. 2000-94700, when an ink supply port is formed on a silicon substrate, a membrane filter is simultaneously formed through an etching resistant mask disposed on one surface opposite to the other surface having a heater by utilizing side etching.

However, according to U.S. Pat. Nos. 6,264,309 and 6,543,884, the recording head is produced by bonding the member in which discharging ports and passages are to be formed with the silicon substrate including the ink supply port. Therefore, dust or foreign matter may infiltrate into nozzles during the bonding process. Furthermore, in the methods disclosed in these patent documents, pores forming a filter are provided through a thin film on the silicon substrate in advance and the ink supply port is formed on the silicon substrate. Accordingly, in these methods, the ink supply port must be formed while pores are open through a stop layer against anisotropic etching, which is disclosed in U.S. Pat. No. 6,139,761. Therefore, when the methods disclosed in the above patent documents are applied to the method disclosed in U.S. Pat. No. 5,478,606, a soluble resin used for forming the passages must be immersed in an etchant used for forming the ink supply port. This process may adversely affect the precision of the head to be produced or the production yield of the head with high precision.

In the method disclosed in Japanese Patent Laid-Open No. 2000-94700, an insulating film composed of, for example, $SiO_2$ or SiN is used as the etching resistant mask. The insulating film (i.e., etching resistant mask) exposed on the reverse face of the silicon substrate is generally formed by sputtering or chemical vapor deposition (CVD). Such an insulating film may be corroded on contact with various types of liquid in the subsequent steps. Also, minute scratches may be formed on the insulating film when the substrate is carried in manufacturing equipment of semiconductors during the production process. Thus, it is very difficult to keep this filter composed of the insulating film without causing any defect until the final product is produced.

SUMMARY OF THE INVENTION

In order to solve the above technical problems, the present invention provides a method for producing an ink-jet recording head that suppresses a discharge failure due to foreign matter such as dust generated in the production process or in use of the ink-jet recording head while the distance between an element for generating an ink-discharging pressure and the discharge ports can be controlled with a very high accuracy, a recording head produced by the method, and an ink-jet cartridge including the recording head.

The present invention provides a method for producing an ink-jet recording head including a plurality of discharge ports for discharging ink, a plurality of ink passages communicating with the plurality of corresponding discharge-ports, and an ink supply port supplying a liquid to the plurality of ink passages. The method includes the steps of preparing a silicon substrate, forming a heat storage layer on a first surface of the substrate, forming a plurality of through-holes communicating with the ink supply port through the heat storage layer, forming heating elements used for discharging the ink on the heat storage layer, forming a protective layer on the substrate including the heat storage layer having the heating elements and the plurality of through-holes, forming a passage-forming member forming the plurality of discharge ports and the plurality of ink passages on the protective layer, forming the ink supply port communicating with a common liquid chamber on the silicon substrate by anisotropic etching from a second surface opposite to the first surface of the substrate, and removing a part of the protective layer using the heat storage layer including the through-holes as a mask to form a filter including the plurality of through-holes.

According to the above method for producing an ink-jet recording head, when the ink supply port is formed, the protective layer and the heat storage layer prevent the ink passages from communicating with the ink supply port. Therefore, even when the passages are formed using a resin mold, the resin forming the mold is not contacted with an etchant used in the anisotropic etching. Furthermore, the filter composed of the heat storage layer and the protective layer can be formed on the surface of the substrate having the ink passages thereon while the ink passages are formed. Therefore, the mixing of dust during production steps such as a step of bonding members need not be considered. In addition, since the filter is not exposed on the surface of a head chip, the filter is not damaged by, for example, handling during the subsequent process such as dicing or bonding on a chip plate. Accordingly, a method for producing an ink-jet recording head that solves the above problems and suppresses a discharge failure due to foreign matter such as dust generated in the production process or in use of the ink-jet recording head can be provided.

According to an ink-jet recording head of the present invention, the ink-jet recording head for recording by discharging ink by a heat generation of heating elements includes a silicon substrate including a plurality of heating elements used for discharging the ink and a ink supply port supplying the ink to the heating elements, and a passage-forming member forming a plurality of discharge ports discharging the ink and a plurality of ink passages communicating with each of the plurality of discharge ports and the ink supply port, each of the discharge ports and each of the ink passages corresponding to each of the plurality of heating elements, wherein the ink supply port includes a filter composed of a heat storage layer and a protective layer provided on the silicon substrate.

The above ink-jet recording head can be easily produced by the above method.

Furthermore, the present invention provides a substrate used for this recording head and an ink-jet cartridge including the recording head.

Further features and advantages of the present invention will become apparent from the following description of exemplary embodiments with reference to the attached drawings.

DESCRIPTION OF THE EMBODIMENTS

Embodiments of the present invention will now be described with reference to the drawings.

Figure 1A:
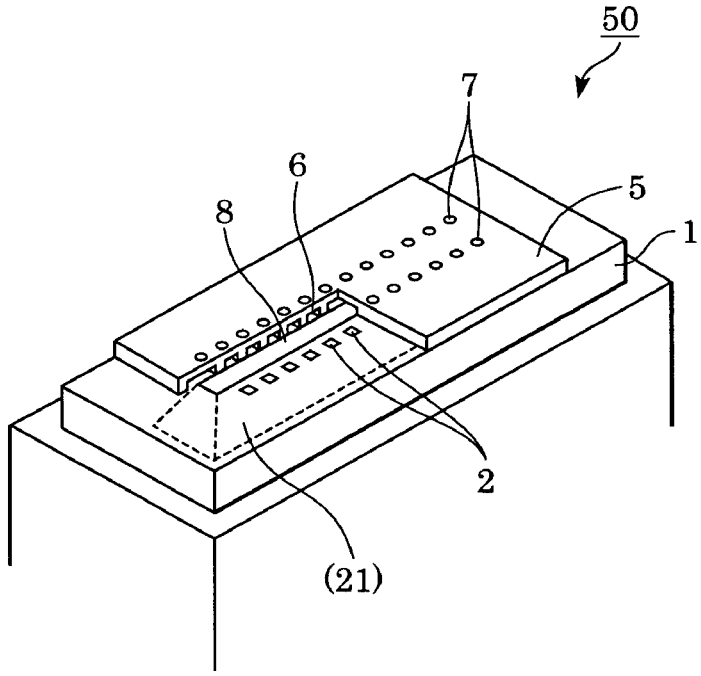
FIG. 1A is a schematic view showing an ink-jet recording head according to an embodiment of the present invention.

FIG. 1A is a schematic view showing an ink-jet recording head according to an embodiment of the present invention.

As shown in FIG. 1A, a recording head 50 includes a silicon substrate 1 and a covering resin layer 5 serving as an orifice plate. The covering resin layer 5 is disposed on the silicon substrate 1 and includes a plurality of discharge ports 7 through which ink is discharged. A common liquid chamber 21 is provided in the silicon substrate 1 as a through-hole. The common liquid chamber 21 stores the ink that is supplied to each of the discharge ports 7. The common liquid chamber 21 forms an ink supply port 8 opening on the top face of the silicon substrate 1. Energy-generating elements 2 (heating elements) providing the ink with thermal energy are disposed at both sides of the ink supply port 8 so as to face each of the corresponding discharge ports 7. Ink passages 6 are provided between the covering resin layer 5 and the silicon substrate 1 whereby the ink from the ink supply port 8 is supplied to each of the discharge ports 7.

The recording head 50 having the above structure is installed in an ink-jet recording unit (not shown) for use. Specifically, when a predetermined electric signal generated in a control unit (not shown) of the ink-jet recording unit is input in the energy-generating elements 2, the energy-generating elements 2 are driven so that the ink bubbles. The ink is discharged from the discharge ports 7 as ink droplets by the energy due to the bubbling.

Figure 1B:
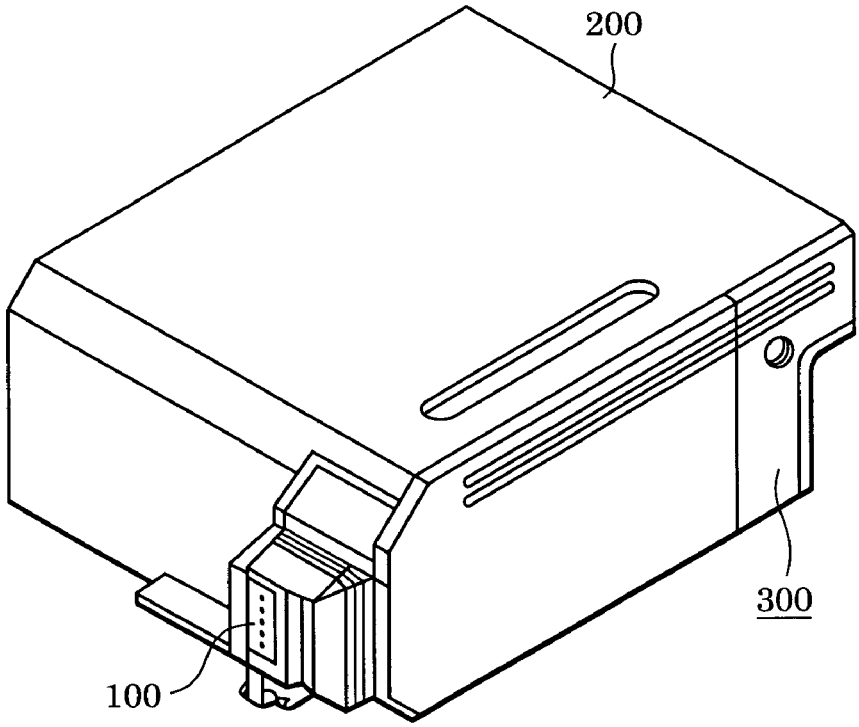
FIG. 1B is a perspective view showing an example of an ink-jet cartridge to which the present invention can be applied.

FIG. 1B is a perspective view showing an example of an ink-jet cartridge including the ink-jet recording head shown in FIG. 1A. An ink-jet cartridge 300 includes an ink-jet recording head 100 described above and an ink storage part 200. The ink storage part 200, which is integrated with the ink-jet recording head 100, stores ink that is supplied to the ink-jet recording head 100.

First Embodiment

The detailed structure of a recording head according to a first embodiment of the present invention will now be described with reference to FIG. 2. A recording head 50 includes a substrate 30 for the recording head and a covering resin layer 5 provided on the substrate 30. The substrate 30 for the recording head includes a silicon substrate 1 serving as a base and a plurality of layers provided thereon. In other words, the recording head 50 without the covering resin layer 5 corresponds to the substrate 30 for the recording head.

A field oxide film 13, a borophosphosilicate glass (BPSG) film 14, a silicon oxide film 16 composed of silicon dioxide, a silicon nitride film 18, and a tantalum film 19 are laminated on the surface of the silicon substrate 1, in that order. Energy-generating elements 2 are disposed on the silicon oxide film 16. In addition, a thermally-oxidized film ($SiO_2$ film) 3 used as a mask during the formation of a common liquid chamber 21 is provided on the reverse face of the silicon substrate 1. In the recording head 50, the silicon oxide film 16, the BPSG film 14, and the field oxide film 13 are provided as a heat storage layer and the silicon nitride film 18 and the tantalum film 19 are provided as a protective layer.

Since the functions of these films have been described in a known document (for example, Japanese Patent Laid-Open No. 2003-136492), the details are not described here. The field oxide film 13 separates a semiconductor device of a driving circuit (not shown in the figure) formed on the silicon substrate 1. The BPSG film 14 and the silicon oxide film 16 function as interlayer insulation films of the driving circuit. The silicon nitride film 18 protects the energy-generating elements 2 and the driving circuit. The tantalum film 19 is provided at areas corresponding to the energy-generating elements 2 of the surface of the silicon nitride film 18. The tantalum film 19 prevents the silicon nitride film 18 from deteriorating due to a cavitation generated in ink. In addition to the function as the protective layer, the silicon nitride film 18 functions as an insulating film insulating the energy-generating elements 2 from the tantalum film 19.

Filter parts 20 are provided at both sides of a sacrificial layer 15, which will be described below (see FIG. 3(*c*)). Each of the filter parts 20 is provided by forming a plurality of through-holes 17 in the silicon oxide film 16 and the silicon nitride film 18. Regarding the flow direction of the ink, the filter part 20 is disposed between the common liquid chamber 21 and an ink passage 6.

The filtration performance of the filter part 20 depends on the diameter and the arrangement pitch of the through-holes 17. For example, the smaller the hole diameter, the higher the filtration performance. However, an excessively small hole diameter may cause a pressure drop of the ink at the filter part 20, thereby impeding the flow of the ink. Accordingly, the hole diameter is determined according to the size of dust or foreign matter to be trapped or characteristics of the ink used. For example, the opening area of a through-hole 17 may be about ½ of the opening area of the discharge port 7. In such a case, dust and foreign matter larger than about ½ of the opening area of the discharge port 7 can be trapped by the filter part 20.

According to the recording head 50 having the above structure, the filter parts 20 can suppress the infiltration of dust or foreign matter in the ink into the ink passages 6 or the discharge ports 7. Accordingly, a discharge failure caused by clogging of dust or foreign matter in, for example, the discharge ports 7 can be prevented to improve the reliability of the recording head 50. Since the filter parts 20 are provided in the silicon oxide film 16 and the silicon nitride film 18, this filter has a mechanical strength higher than that of the filter disclosed in Japanese Patent Laid-Open No. 2000-94700. In addition, the filter parts 20 are provided at the inner side of the substrate 30 for the recording head, compared with the filter disclosed in Japanese Patent Laid-Open No. 2000-94700. This structure is less susceptible to an impact force from the outside. Accordingly, damage to the filter parts 20 in the production process can be decreased. Furthermore, the silicon oxide film 16 and the silicon nitride film 18 serving as the heat storage layer and the protective layer, respectively, are members normally provided in this type of recording head. In other words, the recording head 50 is advantageous in that the filter parts 20 can be formed without using any special member.

In addition to the silicon nitride film 18, a film composed of oxidized silicon may be formed as the protective layer in this embodiment.

Second Embodiment

As a second embodiment of the present invention, an example of a method for producing a recording head of the present invention will now be described with reference to FIGS. 3(*a*) to 3(*j*). According to the method for producing a recording head that will be described below, the recording head 50 shown in FIG. 2 is produced.

Figure 3:
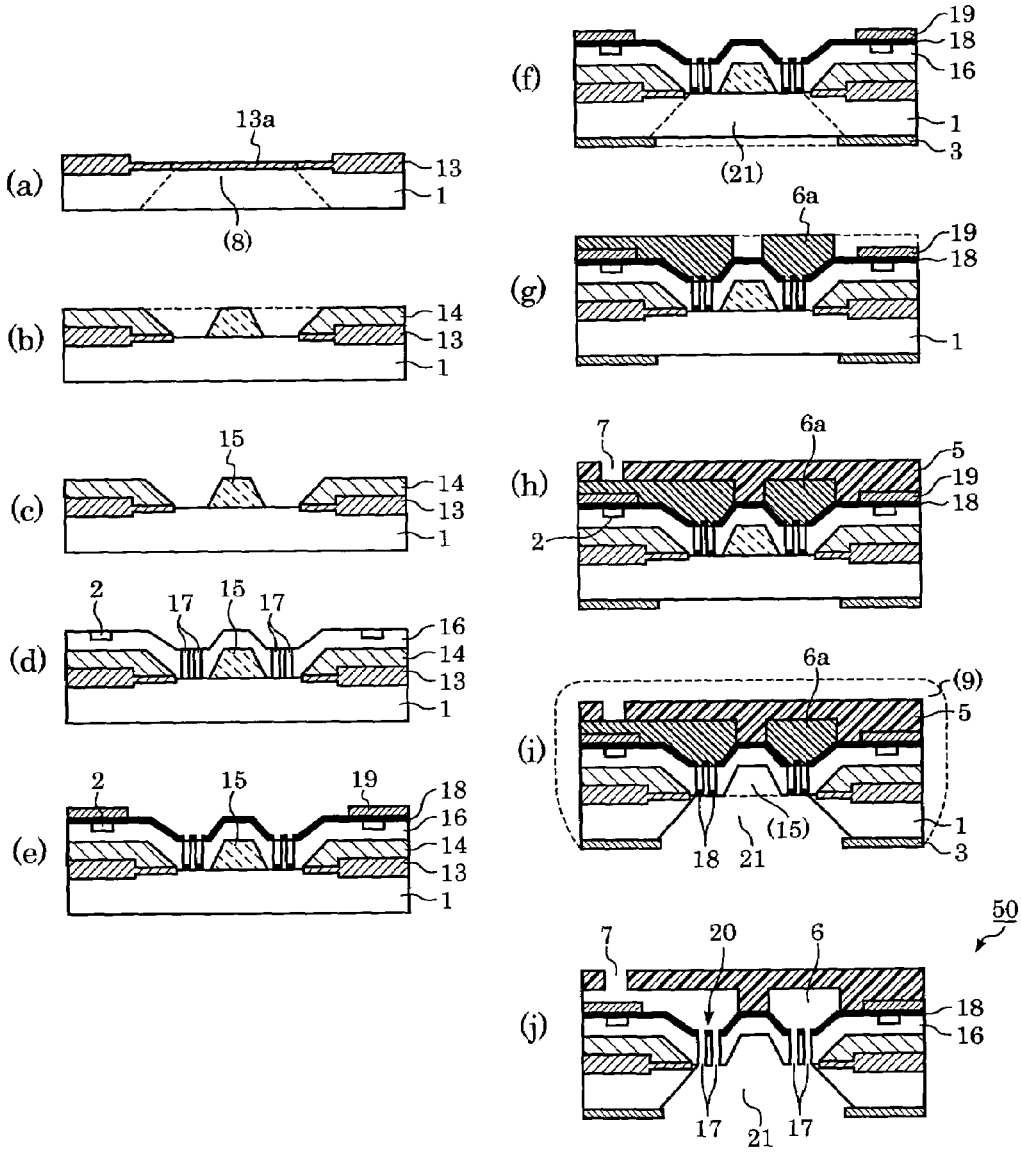
FIGS. 3(*a*) to 3(*j*) are schematic cross-sectional views sequentially showing steps of producing an ink-jet recording head according to a second embodiment of the present invention.

Firstly, as shown in FIG. 3(*a*), a field oxide film 13 is formed on a silicon substrate 1. A silicon nitride film (not shown in the figure) is formed in advance on an area where an ink supply port 8 will be opened, whereby a thin oxide film 13*a* instead of the field oxide film 13 is formed in this area. The silicon substrate 1 may have a crystal orientation of a <100> plane or a <110> plane.

As shown in FIG. 3(*b*), a BPSG film 14 is formed so as to cover the entire field oxide film 13, and a part of the BPSG film 14 and a part of the thin oxide film 13*a* are then removed at the same time according to the area where the ink supply port 8 will be opened. As a result, the silicon substrate 1 is exposed on the area.

As shown in FIG. 3(*c*), a sacrificial layer 15 composed of aluminum is selectively formed at an area where the silicon substrate 1 is exposed. The sacrificial layer 15 will be simultaneously removed in the anisotropic etching step of forming a common liquid chamber 21, which will be described below. Therefore, the material of the sacrificial layer 15 is not particularly limited so long as the sacrificial layer 15 can be dissolved in a strong alkaline aqueous solution.

As shown in FIG. 3(*d*), a silicon oxide film 16 serving as a heat storage layer is formed so as to cover the BPSG film 14 and the sacrificial layer 15, and a plurality of through-holes 17 serving as filter parts 20 are then formed. For example, the through-holes 17 can be simultaneously formed by the step of patterning the silicon oxide film 16. Thus, the process can be simplified. Subsequently, energy-generating elements 2, electrode wiring (not shown), a driving circuit (not shown), and the like are formed on the silicon oxide film 16.

As shown in FIG. 3(*e*), a silicon nitride film 18 serving as a protective layer is formed so as to cover the entire silicon oxide film 16. The silicon nitride film 18 is also formed in the through-holes 17 by this step. A tantalum film 19 is then formed at areas corresponding to the energy-generating elements 2 of the surface of the silicon nitride film 18.

As shown in FIG. 3(*f*), a thermally-oxidized film 3 is formed on the entire reverse face of the silicon substrate 1, and a part of the thermally-oxidized film 3 is then removed such that the thermally-oxidized film 3 functions as an etching mask used for forming the common liquid chamber 21.

As shown in FIG. 3(*g*), a passage resin layer 6*a* composed of a soluble resin material is then applied on the top face of the silicon substrate 1. The passage resin layer 6*a* serves as a mold material in order to form ink passages 6 (see FIG. 2). The passage resin layer 6*a* is then patterned so as to have a predetermined shape according to the shape of ink passages 6.

As shown in FIG. 3(*h*), a covering resin layer 5 is formed so as to cover the passage resin layer 6*a*, and a discharge port 7 is then formed at a position facing the corresponding energy-generating element 2. Although not shown in the figure, a water-repellent layer is formed on the surface of the covering resin layer 5 by, for example, laminating a dry film.

As shown in FIG. 3(*i*), a protective material 9 composed of an etching resistant material is applied so as to cover the entire silicon substrate 1 except for the reverse face thereof. An anisotropic etching is then performed using the thermally-oxidized film 3 as a mask with a strong alkaline aqueous solution to form the common liquid chamber 21. In this etching step, the sacrificial layer 15 is also removed at the same time by isotropic etching. After this etching step, the protective material 9 is removed.

The etching in this step can be performed by a general known method. For example, the etching may be performed by immersing the silicon substrate 1 shown in FIG. 3(*i*) in a 22% tetra-methyl ammonium hydroxide (TMAH) aqueous solution at 80° C. According to the structure disclosed in Japanese Patent Laid-Open No. 2000-94700, a filter is provided in a thermally-oxidized film formed on the reverse face of a substrate. Therefore, for example, a strong alkaline aqueous solution may remain on the filter in the step of anisotropic etching for forming a common liquid chamber. In contrast, according to the present embodiment, such a problem does not occur because an opening of the mask can be completely opened in the thermally-oxidized film 3. Furthermore, in the method for producing a recording head of the present invention, when the ink supply port is formed, the protective layer and the heat storage layer prevent the ink passages from communicating with the ink supply port. Therefore, even when the passages are formed using a resin mold, the resin forming the mold is not contacted with the etchant used in the anisotropic etching.

Subsequently, as shown in FIG. 3(*j*), the silicon nitride film 18 formed in the through-holes 17 is removed by dry etching using the silicon oxide film 16 as a mask so as to pierce the through-holes 17. The dry etching is performed from the reverse face of the silicon substrate 1, that is, from the common liquid chamber 21 side. The soluble passage resin layer 6*a* is then removed from the discharge port 7 and from the common liquid chamber 21 through the through-holes 17 to form the ink passage 6. A substrate 30 for the recording head having nozzle parts formed by the above process is then cut to separate into chips with, for example, a dicing saw. For example, electrode wiring (not shown) driving the energy-generating elements 2 is connected to each chip. Subsequently, a chip tank member (not shown) storing ink that is supplied to the ink supply port 8 is connected to the ink supply port 8 side of the chip, thereby completing an ink-jet recording head 50.

Third Embodiment

The present invention is not limited to the above embodiment. For example, the recording head may have the structure shown in FIG. 4.

Figure 2:
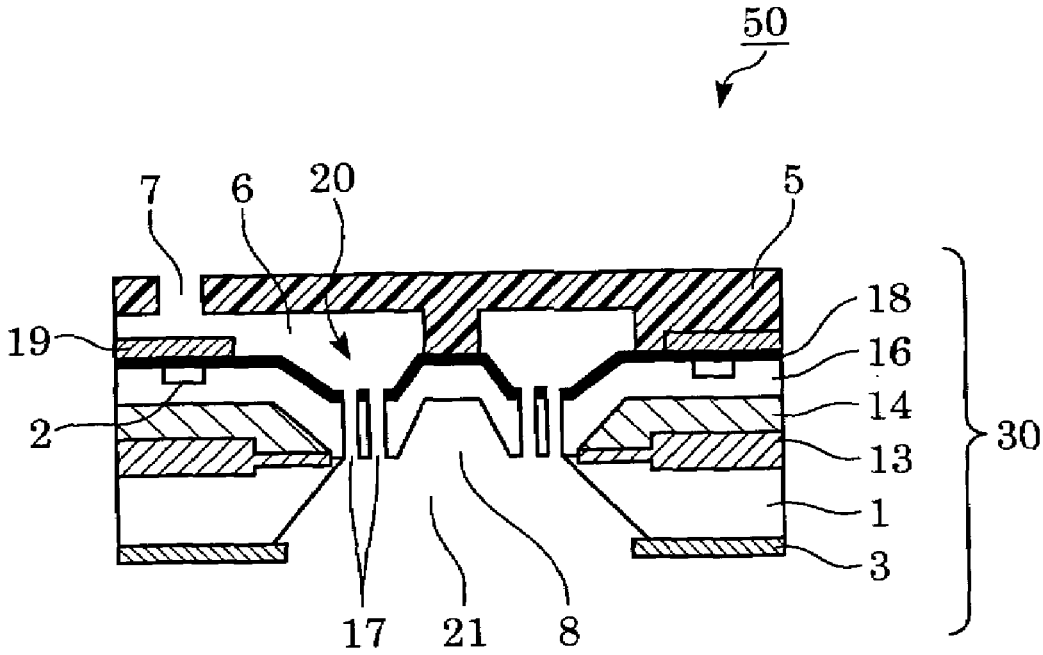
FIG. 2 is a cross-sectional view showing an ink-jet recording head according to a first embodiment of the present invention.
Figure 4:
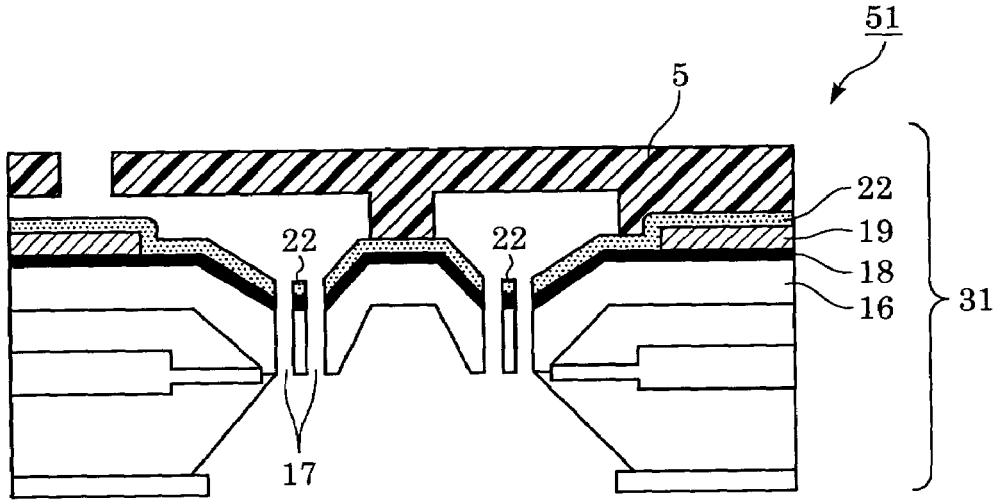
FIG. 4 is a cross-sectional view showing an ink-jet recording head according to a third embodiment of the present invention.

A recording head 51 shown in FIG. 4 includes an adhesive layer 22 in addition to the structure of the recording head 50 in FIG. 2. The adhesive layer 22 functions as a protective layer, and in addition, bonds the covering resin layer 5 with a substrate 31 for the recording head. The adhesive layer 22 is composed of, for example, a thermosetting resin (trade name: HIMAL, from Hitachi chemical Co., Ltd.) and is formed so as to cover the silicon nitride film 18 and the tantalum film 19. Also, the adhesive layer 22 is formed on members disposed between the through-holes 17 of filter parts. The adhesive layer 22 can be formed by patterning a positive resist.

The recording head 51 having this structure improves the bonding strength between the covering resin layer 5 and the substrate 31 for the recording head. Therefore, the covering resin layer 5 is not peeled off easily. Furthermore, since the adhesive layer 22 is also provided in the vicinity of the through-holes 17 of the filter parts, the filter parts have a three-layer structure including the silicon oxide film 16, the silicon nitride film 18, and the adhesive layer 22. Thus, the mechanical strength of the filter parts can be improved.

While the present invention has been described with reference to exemplary embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

This application claims priority from Japanese Patent Application No. 2004-188890 filed Jun. 25, 2004, which is hereby incorporated by reference herein.

What is claimed is:

1. A method for producing an ink-jet recording head including a plurality of discharge ports for discharging ink, a plurality of ink passages communicating with the plurality of corresponding discharge ports, and an ink supply port supplying a liquid to the plurality of ink passages, the method comprising the steps of:

preparing a silicon substrate;

forming a heat storage layer on a first surface of the substrate;

forming a plurality of through-holes communicating with the ink supply port through the heat storage layer;

forming heating elements used for discharging the ink on the heat storage layer;

forming a protective layer on the heating elements and the heat storage layer having the plurality of through-holes;

forming a passage-forming member forming the plurality of discharge ports and the plurality of ink passages on the protective layer;

forming the ink supply port communicating with a common liquid chamber on the silicon substrate by anisotropic etching from a second surface opposite to the first surface of the substrate; and removing a part of the protective layer using the heat storage layer including the through-holes as a mask to form a filter including the plurality of through-holes.

2. The method for producing an ink-jet recording head according to claim 1, wherein the protective layer comprises a silicon oxide or silicon nitride.

3. The method for producing an ink-jet recording head according to claim 1, after the step of forming the protective layer, further comprising the step of laminating a tantalum film on areas of the protective layer corresponding to the heating elements.

4. The method for producing an ink-jet recording head according to claim 1, after the step of forming the protective layer, further comprising the step of forming an adhesion-improving layer composed of a thermoplastic resin or a thermosetting resin on the protective layer, the adhesion-improving layer improving the adhesion between the passage-forming member and the protective layer.

* * * * *